US006263891B1

(12) United States Patent
Hartwell et al.

(10) Patent No.: US 6,263,891 B1
(45) Date of Patent: Jul. 24, 2001

(54) GOLF BAG UMBRELLA

(76) Inventors: Mark S. Hartwell, 1194 Wintercrest Cir., Milford, OH (US) 45150; Michael J. Hartwell, 3154 Skyview Ct., Brighton, MI (US) 48114

( * ) Notice: Subject to any disclaimer, the term of this patent is extended or adjusted under 35 U.S.C. 154(b) by 0 days.

(21) Appl. No.: 09/223,113

(22) Filed: Dec. 30, 1998

(51) Int. Cl.[7] ..... A45B 3/00; A45B 25/00

(52) U.S. Cl. ..... 135/33.2; 135/16; 135/20.3; 135/33.6; 135/15.1; 150/159; 206/315.3

(58) Field of Search ..... 135/16, 15.1, 20.3, 135/33.2, 33.41, 33.6, 33.7, 25.1, 25.4; 150/159; 206/315.3

(56) References Cited

U.S. PATENT DOCUMENTS

| | | | | |
|---|---|---|---|---|
| 109,775 | * | 11/1870 | Stephens . | |
| 1,199,413 | * | 9/1916 | Peyser . | |
| 1,464,830 | * | 8/1923 | Reid et al. . | |
| 2,806,711 | * | 9/1957 | Jacobs . | |
| 3,709,238 | * | 1/1973 | Leopoldi et al. | 135/19 X |
| 4,154,255 | * | 5/1979 | Weaver | 135/16 |
| 4,522,300 | | 6/1985 | Hamblet . | |
| 4,788,996 | | 12/1988 | Forshee . | |
| 4,821,756 | * | 4/1989 | England | 135/19.5 |
| 4,852,896 | * | 8/1989 | Mills . | |
| 5,080,118 | * | 1/1992 | Allen | 135/25.4 |
| 5,172,711 | * | 12/1992 | Mueller et al. | 135/16 |
| 5,226,438 | * | 7/1993 | Dubinsky | 135/33.4 |
| 5,277,211 | | 1/1994 | Hendershot . | |
| 5,287,869 | * | 2/1994 | Wu | 135/25.1 |
| 5,297,570 | | 3/1994 | Conner . | |
| 5,361,792 | * | 11/1994 | Lin et al. | 135/24 |
| 5,387,048 | * | 2/1995 | Kuo | 403/109 |
| 5,441,065 | * | 8/1995 | Lin et al. | 135/24 |
| 5,492,140 | * | 2/1996 | Lin et al. | 135/24 |
| 5,533,541 | * | 7/1996 | Cheng et al. | 135/22 |
| 5,601,103 | * | 2/1997 | Dubinsky | 135/33.7 |
| 5,620,034 | * | 4/1997 | Flis . | |
| 5,626,161 | * | 5/1997 | Lin et al. | 135/24 |
| 5,702,198 | * | 12/1997 | Kuo | 403/377 |
| 5,720,311 | * | 2/1998 | Lin et al. | 135/25.1 |
| 5,890,506 | * | 4/1999 | Kupferman | 135/33.2 |
| 5,992,433 | * | 11/1999 | Chung-Kuang et al. | 135/24 |

FOREIGN PATENT DOCUMENTS

| | | | | |
|---|---|---|---|---|
| 1185765 | * | 8/1959 | (FR) | 135/25.1 |
| 923457 | * | 8/1959 | (DE) | 135/25.1 |
| 1567167 | * | 5/1990 | (SU) | 135/33.2 |

OTHER PUBLICATIONS

Photographs A–D of a typical collapsible umbrella that was publicly disclosed more than one year prior to the filing of this application.

* cited by examiner

*Primary Examiner*—Robert Canfield
(74) *Attorney, Agent, or Firm*—Van Dyke, Gardner, Linn & Burkhart, LLP

(57) ABSTRACT

A golf bag umbrella adapted for use in a golf bag for providing optimal protection to items stored within the golf bag, having an extendable and retractable shaft and a collapsible and expandable canopy, underneath which is a flexible material, preferably mesh or netting, for preventing the golf clubs from becoming entangled in the support structure for the umbrella canopy. The golf bag umbrella further includes a handle, providing easy movement between an extended position and a lowered position while the canopy is expanded, such that the golf clubs within the golf bag may be easily accessible without having to remove the golf bag umbrella from the bag. The protective material beneath the canopy functions to prevent entanglement between the golf clubs and the support structure of the canopy, which prevents damage to both the support structure and the golf clubs themselves while also avoiding frustration on the part of the golfer as the golfer attempts to remove golf clubs from within the golf bag.

52 Claims, 6 Drawing Sheets

GOLF BAG UMBRELLA

BACKGROUND OF THE INVENTION

This invention relates generally to covers for golf bags and, more particularly, to an adjustable umbrella for use in a golf bag which provides optimal protection of golf clubs within the bag, while allowing for easy insertion and removal of the golf clubs.

Golf bags for carrying golf clubs, ball retrievers and other golf equipment and accessories are typically open at the top for easy insertion and removal of the golf clubs. While this provides easy access to the clubs, it also leaves both the clubs and the bag exposed to adverse weather conditions such as when rain is encountered while on the golf course. Exposure to such conditions makes it difficult to continuing playing around of golf as the handles of the clubs become wet and, over time, may even lead to damage of the clubs and the bag.

To address these conditions, various umbrella like covers have been developed to protect the upper end of a golf bag in situations when rain is encountered while on the golf course. However, many of these devices simply protect the golf clubs from the elements, but do not allow for easy removal and insertion of the clubs so that play may easily continue. Such devices may be adequate in cases when a golfer encounters a down pour and cannot continuing playing, but are very difficult to use in situations where there is a light rain or drizzle and the golfer wishes to complete the round of golf.

A typical umbrella device that allows for removal of clubs while the umbrella cover is expanded is disclosed in U.S. Pat. No. 5,297,570, to Conner. Conner provides an umbrella that is positioned above the golf bag and clubs and includes a spring joint such that the umbrella may be bent off to one side to remove the clubs from the bag. While such a design allows for insertion or removal of the clubs from the bag, it fails to provide optimal protection of the clubs during adverse weather conditions due to the fact that the umbrella cover is positioned substantially above the opening of the golf bag, thereby allowing rain to be blown into the space between the umbrella and the top of the golf bag, onto the golf clubs and into the golf bag with a minimal amount of wind.

Another approach to protect golf clubs from adverse weather conditions is to utilize an umbrella that may be lowered down over the golf bag top to better protect the clubs between golf shots and then extend upward to allow access to the clubs for the next shot. A substantial drawback to these proposed designs is that a typical umbrella cover is supported by a support structure made up of collapsible and expandable arms connected to the shaft of the umbrella, which arms extend radially outward to the umbrella cover itself. When such an umbrella is lowered over the golf clubs within a golf bag, the subsequent sudden motions of the golf bag and clubs, while being transported around a golf course, cause the heads of the clubs to constantly come into contact with the support structure, thereby becoming entangled within the support structure and even bending and damaging the support structure of the umbrella. Not only does this lead to a very short useful life of such an umbrella, as the support structure quickly becomes damaged beyond repair, but this also leads to frustration on the part of the golfer as it becomes an ongoing struggle to raise the umbrella, so as to remove a club, when several clubs are entangled within the support structure. In addition, in some situations, the support structure can even scratch, mar or otherwise damage the exposed club heads.

Still yet another approach to protecting golf clubs within a golf bag, while still allowing for insertion and removal of the clubs, is disclosed in U.S. Pat. No. 4,788,996, to Forshee. Forshee discloses a foldable golf bag cover that expands over the golf clubs in a golf bag and allows for removal of the clubs by pushing downward at its top, which causes the umbrella-like cover to invert and subsequently be pushed into a mounting tube projecting upwardly from the opening of the golf bag. Such a device again allows for insertion and removal of a club, but fails to provide protection to the other clubs while a selected club is removed from the bag or replaced into the bag, as the entire umbrella is collapsed each time a club is removed from the bag. An additional concern with this design is that it is very bulky, as the mounting tube has a very large diameter relative to the size of the clubs and thus takes up a substantial amount of space within the opening of the golf bag, even when it is not in use. This is a substantial drawback to an avid golfer, who typically has fourteen different golf clubs within the bag, so that there may not be enough room for a large diameter tube similar to the one disclosed in Forshee, especially if smaller, lighter carry bags are used. Furthermore, such a device is not easily stored in the golf bag during times when it is not raining. Even in its stored position, the large diameter tube extends upward from the opening of the golf bag to a point substantially above the heads of the longest clubs, and thus may interfere with a golfer's access to the golf clubs, regardless of whether it is raining or not.

Therefore, there is a need in the field of golf bag covers to provide a golf bag umbrella which offers optimal protection of the golf bag and the clubs therein while the bag and clubs are transported along the golf course, while also allowing for easy removal and insertion of a selected club for each shot during the round of golf. Furthermore, the golf bag umbrella must be durable as it is constantly in contact with the heads of the clubs, while also being easy for the golfer to raise and lower without the clubs being caught in its support structure. Finally, the golf bag umbrella must be collapsible and very compact such that the umbrella takes up a minimal amount of space within the golf bag when not in use.

SUMMARY OF THE INVENTION

In recognition of the above problems, the present invention provides a golf bag umbrella which results in optimal protection of golf clubs within the golf bag and yet provides easy access to the golf clubs while being easily inserted within the golf bag due to its compact size and collapsibility.

According to a first aspect of the invention, a golf bag umbrella for protecting items in a golf bag includes a shaft, a canopy and a protective cover. The canopy attaches to an upper end of the shaft and further includes an exterior surface, an underside and a support structure which supports the canopy and secures the canopy to the shaft. The protective cover extends over at least a portion of the shaft and support structure and is secured to at least one of the underside of the canopy and the support structure. The protective cover prevents items such as golf clubs within the golf bag from becoming entangled in and/or damaged by the support structure, while the support structure is protected from being damaged by the items within the golf bag.

According to another aspect of the invention, the golf bag umbrella may be easily extended upwardly from a lowered position over the golf bag, to provide for easy removal and insertion of golf clubs within the golf bag, while still providing adequate protection to the clubs remaining in the bag as the golfer removes a selected club for the next shot. After each shot is completed, the golf bag umbrella may be easily returned to its lowered position directly above the heads of the clubs, thereby providing optimal protection of the clubs and the bag.

Still yet another aspect of this invention is to provide a golf bag umbrella that is highly compact and easily stored within the golf bag, being collapsible to roughly the size of a typical golf club and taking up a minimal amount of space within the golf bag, when it is not in use.

These and other objects, advantages, purposes and features of this invention will become more apparent upon review of the following specification in conjunction with the drawings.

BRIEF DESCRIPTIONS OF THE DRAWINGS

DESCRIPTION OF THE PREFERRED EMBODIMENT

Figure 1:
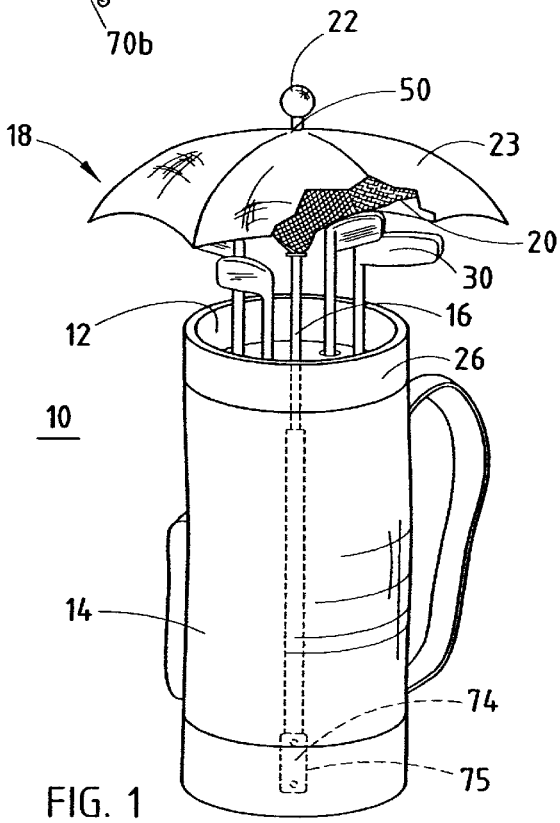
FIG. 1 is a perspective view of the present invention while expanded to cover the golf bag opening and clubs, but in its lowered position within the golf bag.

Referring now specifically to the drawings, there is shown in FIG. 1 a golf bag umbrella 10 which is inserted within a cavity 12 of a golf bag 14. Golf bag umbrella 10 includes a shaft 16, a canopy 18, a protective cover 20, and, preferably, a handle 22. Canopy 18 includes a cloth-like rain cover 23, typically formed from flexible, water-resistant cloth or fabric, which is expandably and collapsibly secured to shaft 16 by a support structure 24. Golf bag umbrella 10 is positionable in golf bag 14 such that canopy 18 may be expanded over an upper portion 26 of golf bag 14, thereby protecting golf clubs or other items within golf bag 14 from adverse weather conditions. While expanded, canopy 18 of golf bag umbrella 10 may be positioned at a lowered position where canopy 18 is at a height slightly above the tallest golf club, such as a driver or the like, within golf bag 14. Protective cover 20 then functions to prevent the golf clubs, shown generally at 30, from becoming entangled within support structure 24 of canopy 18.

Figure 2:
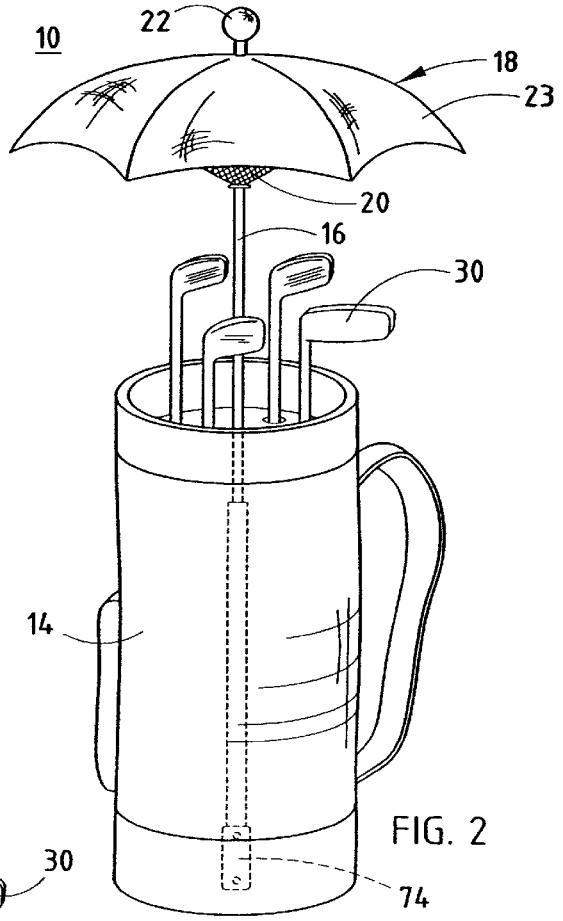
FIG. 2 is a perspective view of the present invention also while expanded to cover the golf bag opening and clubs, but in its extended, raised position above the golf clubs in a golf bag.
Figure 3:
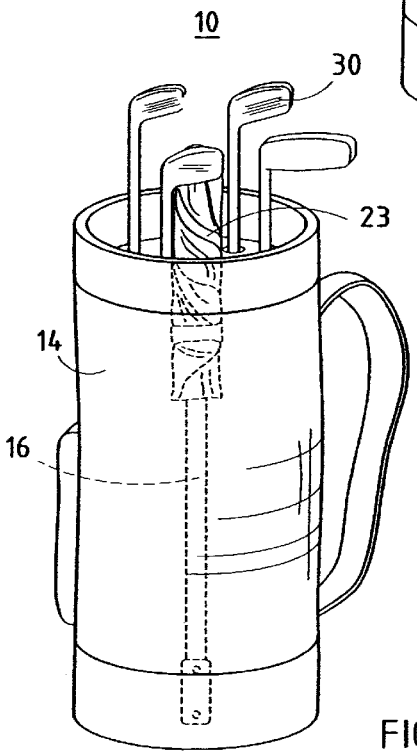
FIG. 3 is a perspective view of the present invention in its stored position within a golf bag.

As shown in FIG. 2, shaft 16 of golf bag umbrella 10 is preferably extendable to an extended position while canopy 18 remains expanded. This extended position allows the golfer to remove or insert golf clubs 30 within golf bag 14 from the space between the canopy and the top of the golf bag without interference from canopy 18 of golf bag umbrella 10. Once the golfer has removed or replaced the selected golf club, the golf bag umbrella may be easily returned to the lowered position shown in FIG. 1, to again provide optimal protection from the weather of golf clubs 30 within golf bag 14. Finally, as shown in FIG. 3, golf bag umbrella 10 is preferably fully collapsible, such that canopy 18 is folded and wrapped around shaft 16, thereby providing a sleek, compact umbrella 10 for easy storage within golf bag 14 when it is not raining. Shaft 16 may also be fully retractable so that umbrella 10 may be collapsed to a size of a typical golf club and preferably to a size substantially similar to a short iron, such as a typical 9 iron or pitching wedge, thereby taking up a minimal amount of space within golf bag 14.

Figure 4:
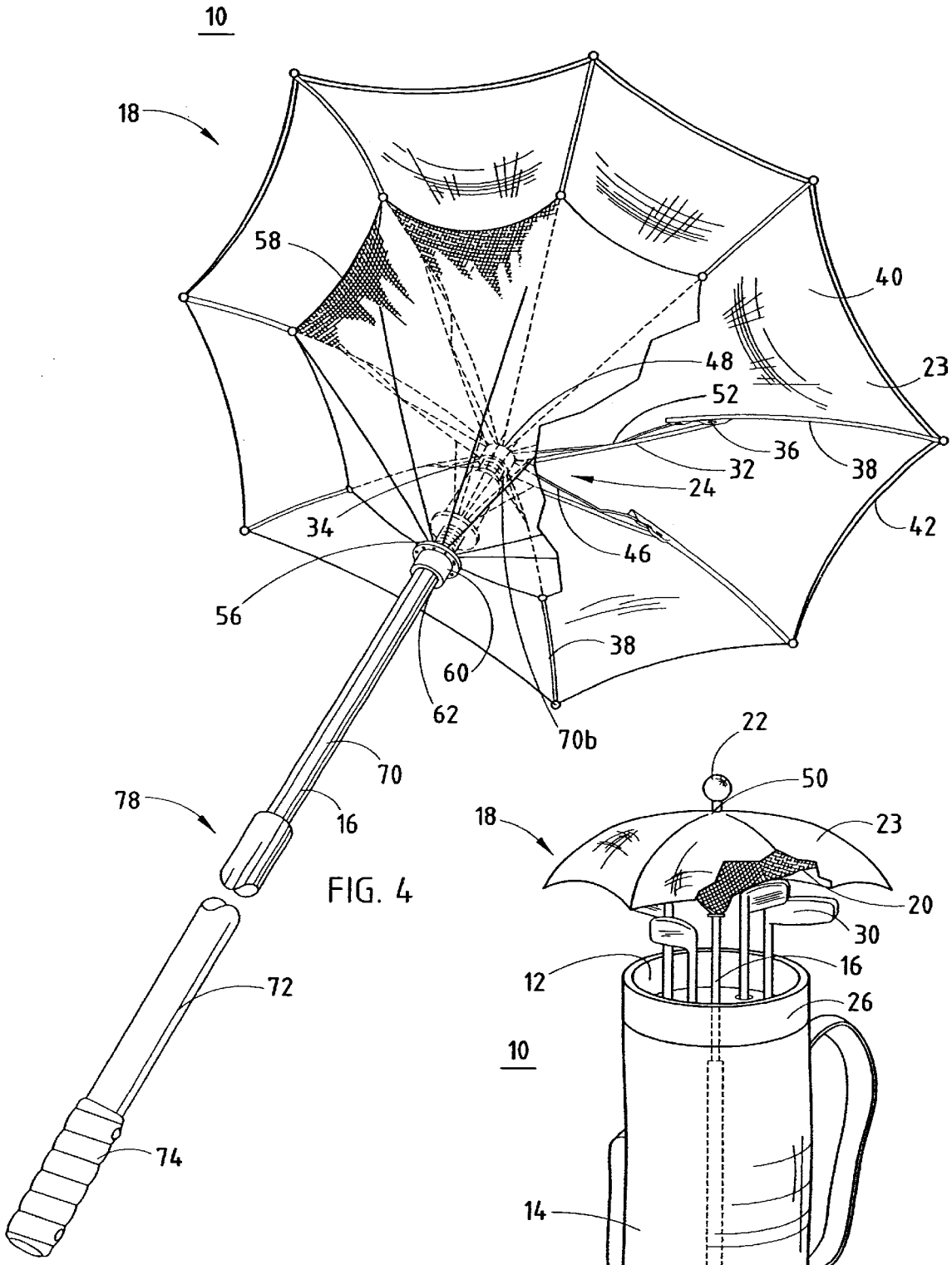
FIG. 4 is a perspective underside view of the present invention in its extended and expanded position.

Canopy 18 of golf bag umbrella 10 is preferably substantially similar to a standard, compact and collapsible personal umbrella, and includes both a support structure 24 and rain cover 23. Rain cover 23 is preferably durable but also highly flexible and collapsible, and also substantially water repellant, and is typically made from a cloth-like woven fabric or membranous material, such as woven nylon fabric or the like. Alternately, flexible resinous plastic or composite materials such as thin vinyl sheeting or the like may be used. Support structure 24 of canopy 18, as best shown in FIG. 4, may include a plurality of substantially straight and unattached or free arms 32 extending radially outward from an inner lower ring 34 to an outer pivot joint 36, where free arms 32 hingably connect to a plurality of elongated, substantially straight but resilient attached arms 38. Attached arms 38 are typically secured along an underside 40 of rain cover 23, and further extend radially outward from outer joint 36 to a circumferential edge 42 of rain cover 23 where they are each secured to cover 23, thereby providing rigidity to cover 23 towards its outer edge 42 when structure 24 is expanded. Support structure 24 may also include a plurality of downward extending arms 46, which extend radially outward and downward from an upper ring 48, upon which a center point 50 of rain cover 23 is secured (FIG. 1). Downward extending arms 46 are hingably mounted near a mid-point 52 of free arms 32 and cooperate with free arms 32 to fully expand rain cover 23 to an expanded state as lower ring 34 is telescopingly moved upward along shaft 16. Once rain cover 23 and support structure 24 are fully expanded to an expanded cover area of canopy 18, inner ring 34 is secured in place by a conventional latch mechanism (not shown) on shaft 16. The latch mechanism is not critical to the present invention and may be any typical latch mechanism as used in standard umbrellas. When expanded, the exterior of the cover is taut and sufficient to block rain and the like from entering bag 14. Support structure 24 further movably cooperates to allow rain cover 23 to be fully collapsed to a compact cover area of canopy 18, as support structure 24 is collapsed by moving lower ring 34 downward along shaft 16. Although a particular umbrella support structure design is discussed herein, clearly other means for expanding and collapsing a canopy and rain cover of an umbrella may be implemented without affecting the scope of the present invention.

Protective cover 20 is preferably made of a durable, flexible and breathable material, such as a mesh netting, webbing, or the like, formed from synthetic or cloth fibers or other similar material, an example of which is the material of a bathing suit liner or the like. Protective cover 20 has an inner circumferential edge 56 and extends radially outward therefrom to an outer circumferential edge 58. Inner edge 56 is secured to an inner ring 60 which further includes a circular opening 62 through its center. Inner edge 56 of protective cover 20 may be secured to inner ring 60 by sewing or otherwise securing the edge 56 to a plurality of holes or openings along inner ring 60. As explained below, outer edge 58 is secured either to the underside of cover 23, or to support structure 24, or both.

As is also shown in FIG. 4, shaft 16 of golf bag umbrella 10 is extendable and retractable between a fully extended position, a lowered position and a closed position, and preferably includes an inner upper tube 70 and an outer lower tube 72 having a slightly larger diameter than upper tube 70 such that shaft 16 extends and retracts telescopically, with upper tube 70 slideably inserting within lower tube 72. Lower tube 72 may further include a base handle 74 which rests upon a bottom surface 75 of golf bag 14 when golf bag umbrella 10 is placed within golf bag 14. Base handle 74 may further be adapted to be fixably mounted to bottom surface 75 of golf bag 14 to further stabilize golf bag umbrella 10 within golf bag 14.

Figure 6A:
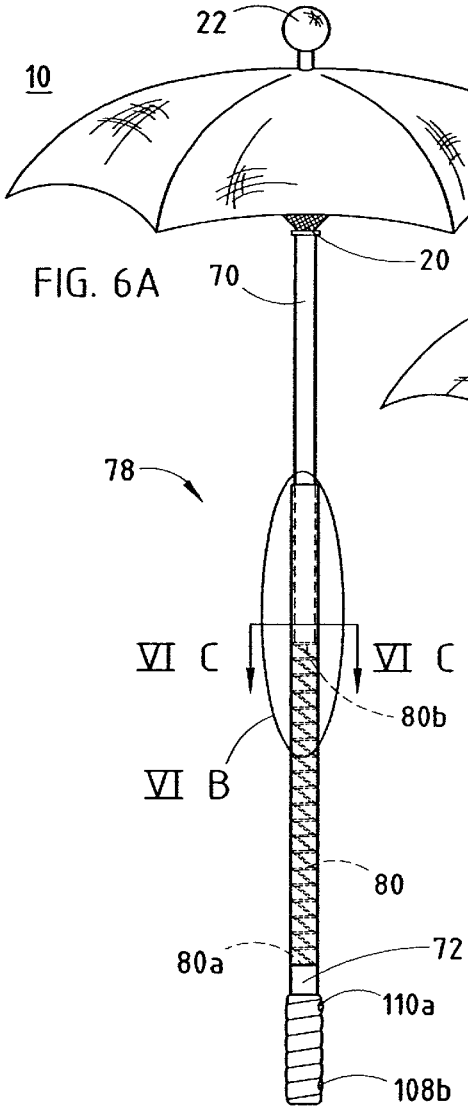
FIG. 6A is a side view of the present invention in its extended and expanded position, as used in FIG. 2.
Figure 7A:
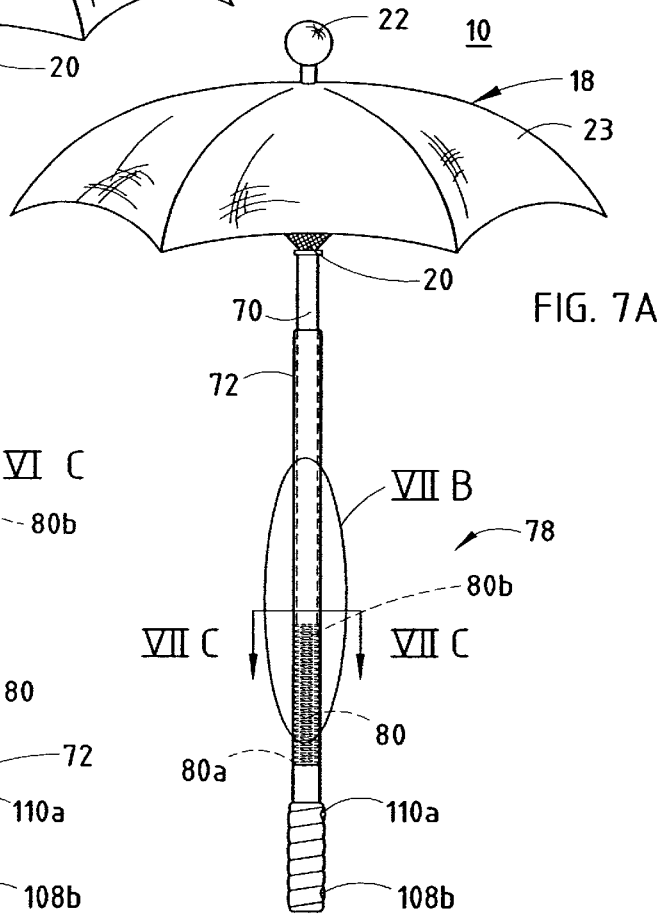
FIG. 7A is a side view of the present invention in its lowered and expanded position, as used in FIG. 1.
Figure 6C:
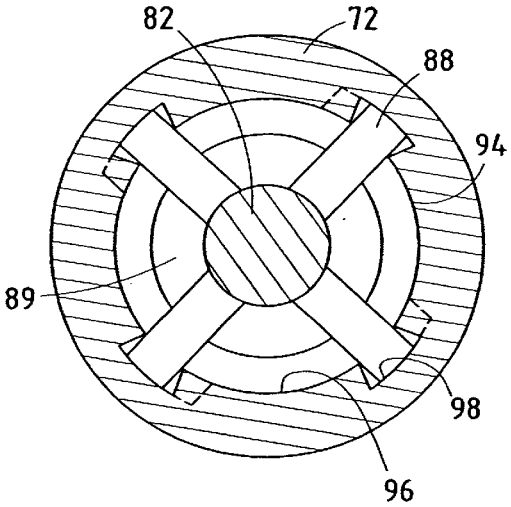
FIG. 6C is a cross-sectional view taken substantially along line VI C—VI C in FIG. 6A.
Figure 6B:
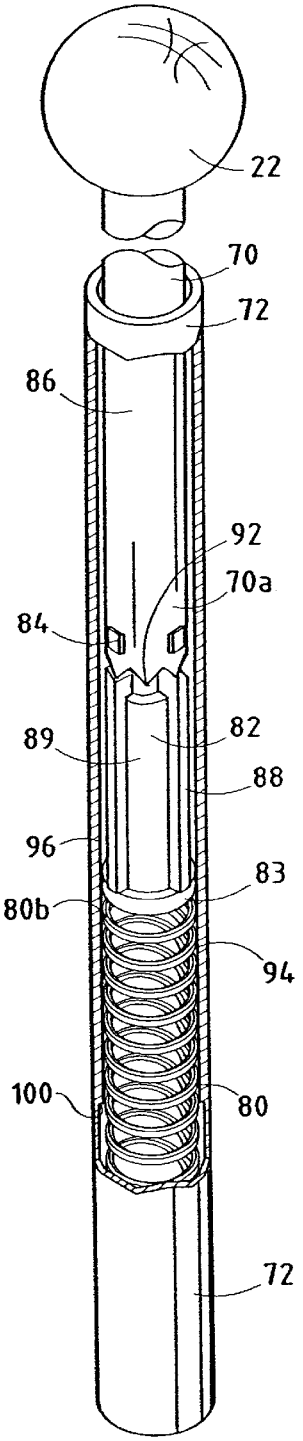
FIG. 6B is an enlarged partial cross-sectional view of area VI B in FIG. 6A.

Shaft 16 may further include a locking mechanism 78, best seen in FIGS. 6 A–C and 7 A–C, which secures upper tube 70 relative to lower tube 72 in each of the shaft positions. In order to allow golf bag umbrella 10 to easily extend and retract between the fully extended position and the lowered position, locking mechanism 78 preferably includes a spring 80 and an end piece 82 within shaft 16, which engage one another and cooperate with upper and lower tubes 70 and 72 to secure shaft 16 in either an extended position (FIG. 6A) or a lowered position (FIG. 7A). Spring 80 extends longitudinally within lower tube 72 from an anchored or fixed lower point 80*a* upwardly to an upper end 80*b* which contacts a lower end 83 of end piece 82 on upper tube 70. End piece 82 is rotatably mounted within a lower end 70*a* of upper tube 70 and has a plurality of arms 88 extending outward from a center portion 89 and including angled upper ends 90 for engaging a plurality of teeth 92 on lower end 70*a* of upper tube 70 (FIG. 6B). Upper tube 70 further includes a plurality of outwardly protruding tabs or guides 84 on its exterior surface 86 near lower end 70*a*. Lower tube 72 is formed with a plurality of radially inwardly projecting columns 94 extending longitudinally along an inner surface 96 of lower tube 72 such that a plurality of channels 98 are formed longitudinally within lower tube 72 between columns 94. The sidewalls of lower tube 72 may be formed in this manner, or a molded inner section may be inserted within lower tube 72 to provide the channels and columns within lower tube 72. At a lower end 100 of each column 94 is a notch 102 corresponding to upper ends 90 of arms 88 on end piece 82, while an upper end of each channel 98 provides an upper positive stop. The lower end 100 of columns 94 may further provide a ramped surface 98a immediately adjacent each channel to cause rotation of end piece 82 such that arms 88 move to engage channels 98, as discussed below. The number of tabs 84, arms 88, columns 94 and channels 98 are substantially the same, and preferably three or more of each. However, clearly more or less of each may be provided without affecting the scope of the present invention.

Figure 7C:
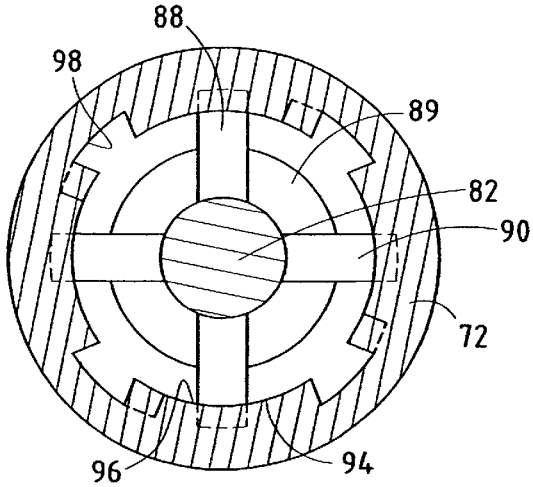
FIG. 7C is cross-sectional view taken substantially along line VII C—VII C in FIG. 7A.

When assembled, a cylindrical portion 82*a* of end piece 82 inserts into lower end 70*a* of upper tube 70 such that arms 88 of end piece 82 extend outward, engaging teeth 92 on lower end 70*a* and extending further outward to engage either notches 102 on lower end 100 of columns 94 in the lowered position (FIGS. 7B and 7C) or channels 98 in the extended position (FIG. 6C). Tabs 84 on upper tube 70 slideably engage channels 98 to prevent rotation of upper tube 70 relative lower tube 72 and to contact the upper end (not shown) of channels 98 in the extended position, thereby providing a positive stop at a predetermined height above golf bag 14. Spring 80 contacts lower end 83 of end piece 82 and pushes upwards on end piece 82 and upper tube 70. The force exerted by spring 80 prevents accidental downward movement of upper tube 72 relative lower tube 72 and thus retains shaft 16 in each of its positions.

Figure 8:
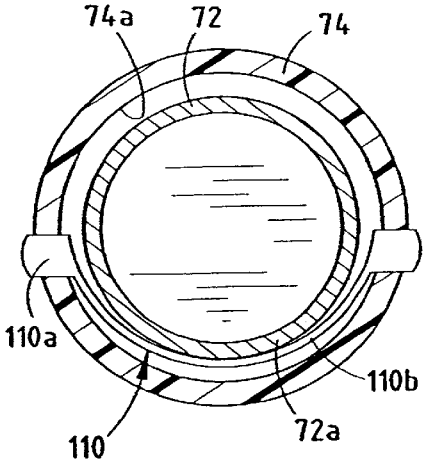
FIG. 8 is a cross-sectional view taken substantially along line VIII—VIII in FIG. 5.

Base handle 74 preferably is also slidably secured to a lower end 72*a* of lower tube 72 of shaft 16. Base handle 74 may include at least one upper hole 108*a* and at least one lower hole 108*b*, through which a locking pin or the like may protrude to fixedly secure base handle 74 relative to lower tube 72. The locking pin may be in the form of a horseshoe clip 110, which has one or more substantially rounded extensions 110*a* connected by a spring biased band 110*b* secured on lower tube 72 toward a lower end 72*a* thereof (FIG. 8). The rounded extensions 110*a* protrude through handle 74 at one or more upper holes 108*a* or lower holes 108*b*, which correspond to the raised positions and storage position of golf bag umbrella 10, respectively. Handle 74 and lower tube 72 are set at the raised position when canopy 18 is expanded for use and at the lowered, stored position when canopy is collapsed into its compact orientation.

As assembled, canopy 18 of golf bag umbrella 10 is secured at an upper end 70*b* of upper tube 70 of shaft 16, such that upper ring 48 of support structure 24 is fixedly mounted at upper end 70*b*, while lower ring 34 of support structure 24 is slideably mounted along upper tube 70 at a point below upper ring 48. Protective cover 20 secures along its outer circumferential edge 58 along underside 40 of rain cover 23. Outer edge 58 of protective cover 20 may be secured under rain cover 23 at spaced points such as joints 36, where free arms 32 of support structure 24 also secure to rain cover 23, or alternatively, outer edge 58 may be sewn or otherwise attached to underside 40 of rain cover 23, without affecting the scope of the present invention. Upper tube 70 extends through circular opening 62 in inner ring 60 of protective cover 20, such that inner ring 60 is slideably positioned along upper tube 70 at a point below lower ring 34 of support structure 24, thereby encasing free arms 32 and downward extending arms 46 of support structure 24 between rain cover 23 of canopy 18 and protective cover 20. Inner ring 60 of protective cover 20 moves along upper tube 70 to enable protective cover 20 to fully expand under support structure 24 as canopy 18 is expanded, while further allowing protective cover 20 to collapse downward beneath support structure 24 as canopy 18 is collapsed. When canopy 18 is expanded, protective cover 20 is also expanded beneath support structure 24 such that protective cover 20 is tightly drawn between inner ring 60 and outer edge 58, thereby providing a semi-rigid protective encasement of support structure 24. Furthermore, when canopy 18 is collapsed, protective cover 20 drapes downward within the collapsed canopy, such that protective cover 20 is substantially contained within canopy 18 when the canopy is collapsed for storage.

Figure 14:
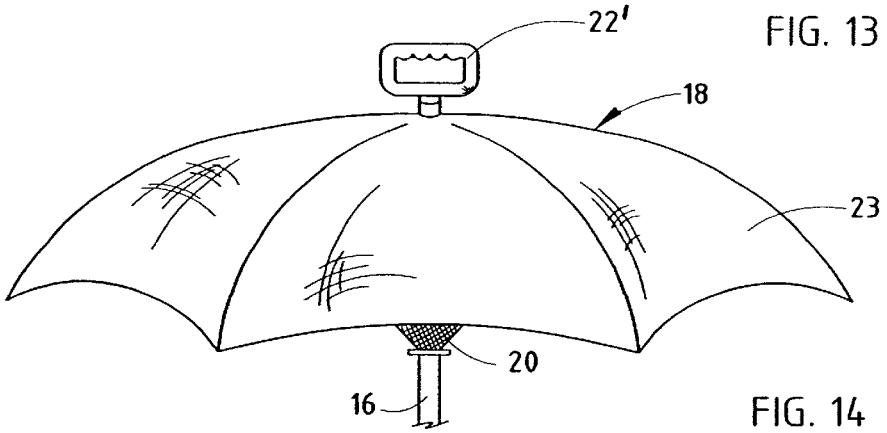
FIG. 14 is another alternate embodiment of the present invention.
Figure 15:
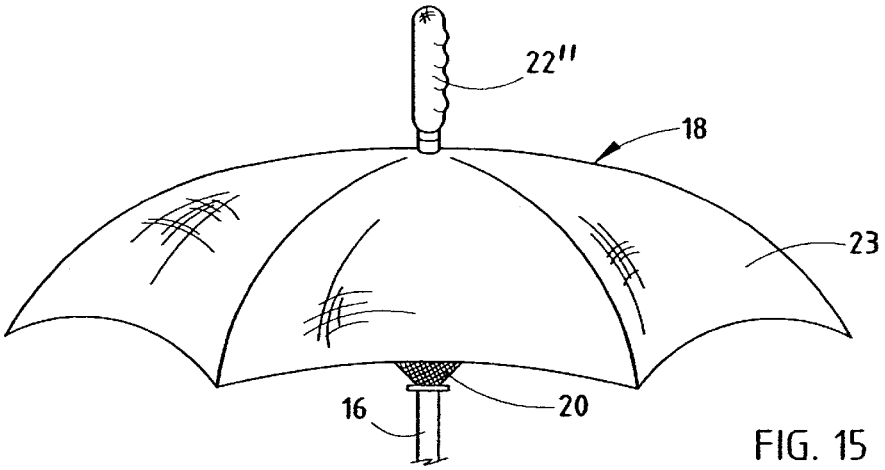
FIG. 15 is another alternate embodiment of the present invention.

Immediately above upper ring 48 of canopy 18 may be mounted a handle 22, so that golf bag umbrella 10 is easily extended and retracted while it rests within golf bag 14. Although handle 22 is shown as a golf ball shape, handle 22 may alternatively be a substantially ring-shaped handle 22', as shown in FIG. 14, or a grip-type handle 22" as shown in FIG. 15, without affecting the scope of the present invention.

Figure 7B:
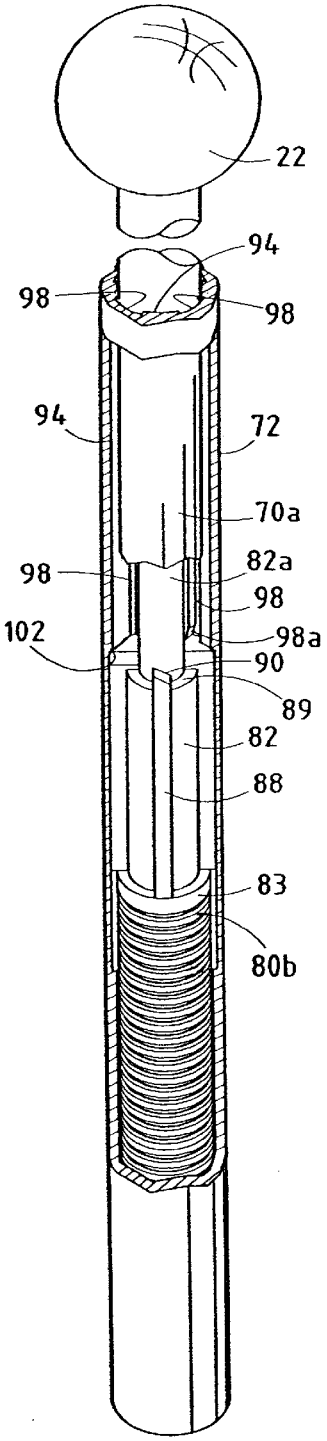
FIG. 7B is an enlarged partial cross-sectional view of area VII B in FIG. 7A.

When golf bag umbrella 10 is expanded for use in a golf bag 14, lower tube 72 is moved upward within base handle 74 such that rounded extensions 110*a* protrude through upper holes 108*a* in base handle 74. This positions canopy 18 and protective cover 20 at the lowered, in use position where a minimal clearance is provided between rain cover 23 and a typical long golf club such as a driver or the like. Arms 88 of end piece 82 engage lower ends 100 of columns 94 to prevent upper tube 70 and canopy 18 from rising upward beyond the lowered position, as spring 80 exerts a force upward on end piece 82 to retain this position (FIG. 7B). This secures golf bag umbrella 10 in its lowered position such that canopy 18 rests immediately above the tallest of golf clubs 30 and extends radially outwardly to a position outside the top opening of golf bag 14, thereby providing optimal protection of the golf clubs 30 and other items within golf bag 14 when it is raining on the golf course (FIG. 1). Protective cover 20 extends radially outward from shaft 16 underneath free arms 32 of support structure 24 and is tightly drawn therebetween to prevent golf clubs 30 or other items within golf bag 14 from becoming entangled within support structure 24. Protective cover 20 not only prevents damage to support structure 24, as golf clubs 30 and support structure 24 no longer become entangled, but also functions to protect golf clubs 30 from being scratched or otherwise damaged by support structure 24 or other elements of canopy 18.

When a golfer wishes to continue a round of golf while it is raining outside, golf clubs 30 must not only be kept dry, but also must be easily accessible to the golfer. Therefore, golf bag umbrella 10 may be easily extended such that canopy 18 is substantially above golf clubs 30 within golf bag 14. This is accomplished simply by pressing downward on handle 22, which depresses spring 80, until upper ends 90 of arms 88 on end piece 82 are moved downward below a lower edge of notches 102 on columns 94 within lower tube 72. At this point, end piece 82 rotates as upper ends 90 slide into a valley formed by teeth 92 to align arms 88 between notches 102 and channels 98. As handle 22 is subsequently released, upper tube 70 and canopy 18 rise upward, as spring 80 pushes upward on end piece 82, and arms 88 of end piece 82 rotate further as they slide along the ramped surface 98a of the columns 94 and are thus guided into channels 98. Spring 80 raises or extends shaft 16 until tabs 84 of upper tube 70 contact the upper end of channels 98, thereby providing a positive stop at the extended position. At this extended position, golf clubs 30 may be easily removed from golf bag 14 for use by the golfer in the next shot, while likewise being easily replaced back into golf bag 14 upon completion of the shot, as the extended position provides adequate clearance between golf bag 14 and canopy 18. Protective cover 20 further prevents golf clubs 30 or other items within golf bag 14 from becoming entangled within support structure 24 as they are removed from golf bag 14. Once the selected golf club has been removed from the bag 14, handle 22 may be pushed downward to return golf bag umbrella 10 to its lowered, in use position. Once handle 22 is pushed downward, and spring 80 is compressed, such that arms 88 of end piece 82 are below the lower edges of the channels 98, end piece 82 is again allowed to rotate relative upper tube 70 and spring 80 to realign arms 88 with teeth 92 on lower end 70*a* of upper tube 70. As handle 22 is again released, arms 88 rotate further to engage notches 102 in columns 94, thereby preventing further upward movement of upper tube 70 and again securing shaft 16 in its lowered, in use position.

Figure 5:
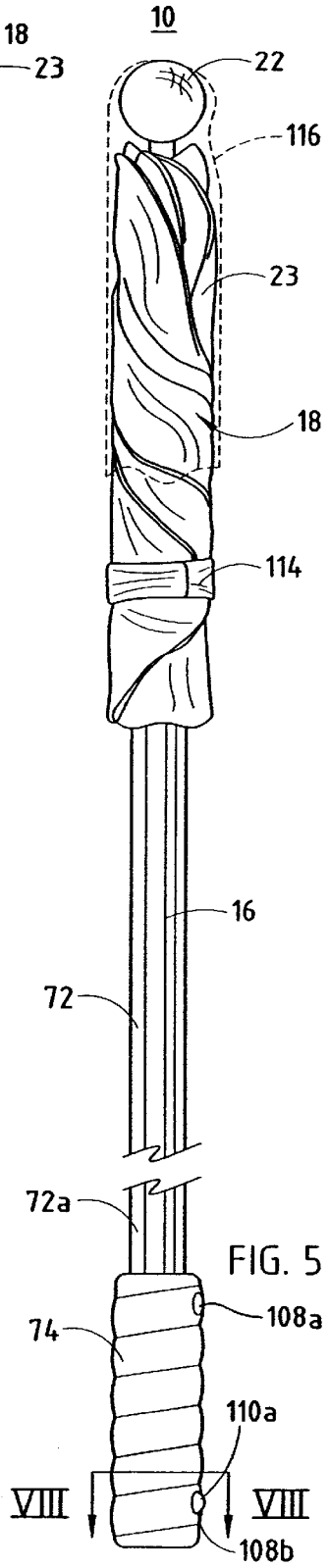
FIG. 5 is a side view of the present invention in its fully collapsed, compact state.

In situations where rain is not present on the golf course, canopy 18 may be compactly folded and wrapped about shaft 16, as shaft 16 is retracted to its shortened, closed position shown in FIG. 5. Shaft 16 may be shortened to the size of a small club such as a 9 iron, pitching wedge or the like, by setting golf bag umbrella to its lowered position and further sliding lower tube 72 into base handle 74 until rounded extensions 110*a* protrude through lower holes 108*b* in base handle 74. This is accomplished easily by pressing inward on rounded extensions 110*a* as they protrude through upper holes 108*a*, and sliding lower tube 72 downward relative base handle 74, while rounded extensions slide along an interior surface 74*a* of base handle 74, until rounded extensions 110*a* engage lower holes 108*b* in base handle 74. Rain cover 23 may include a band or strap 114 or other means to secure canopy 18 in a tightly wrapped closed position. Golf bag umbrella 10 may further include a sleeve 116, into which canopy 18 and handle 22 may be inserted to further maintain canopy 18 in its compact, tightly wrapped orientation. By providing a sleek, compact umbrella such as described herein, golf bag umbrella 10 takes up a minimal amount of space within golf bag 14 when not in use. However, golf bag umbrella 10 could instead be stored along an outside surface of golf bag 14 as a typical golf umbrella is stored, without affecting the scope of the present invention.

Figure 9:
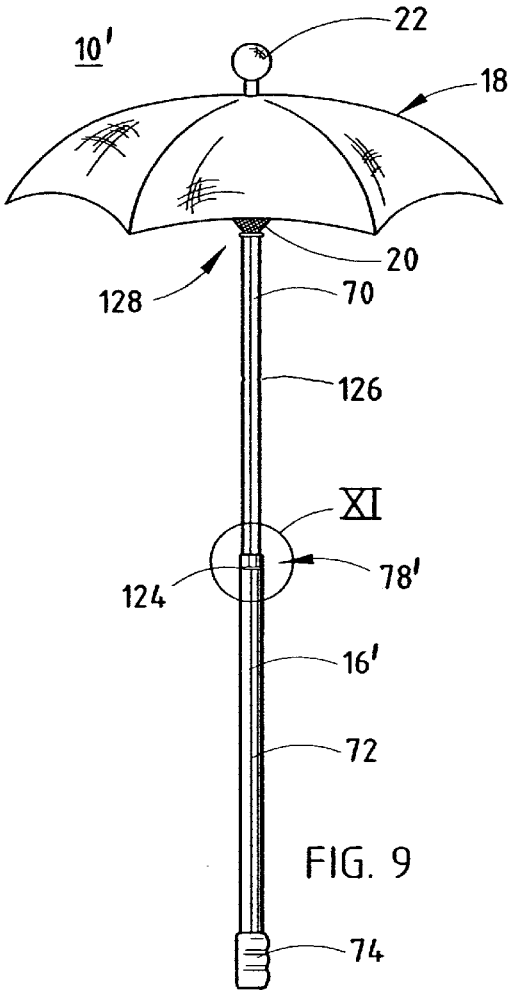
FIG. 9 is a side view of an alternate embodiment of the present invention in its extended and expanded position, similar to that of FIG. 6A.
Figure 10:
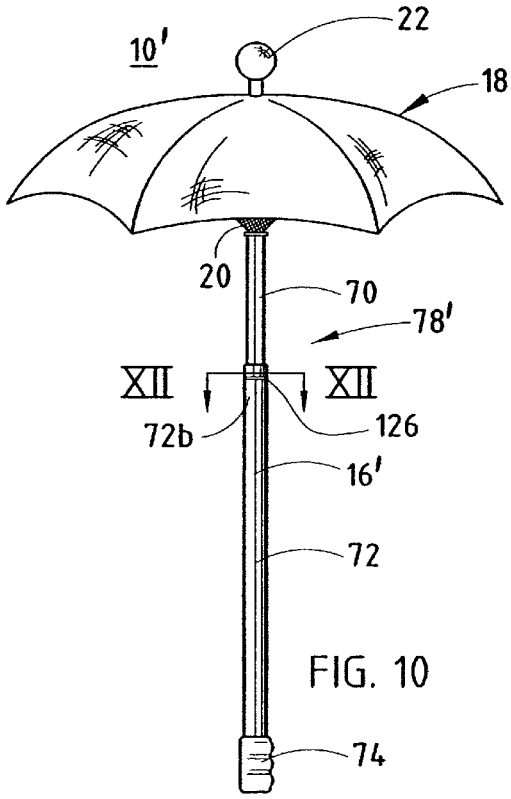
FIG. 10 is a side view of the embodiment of FIG. 9 in its lowered and expanded position, similar to that of FIG. 7A.
Figure 11:
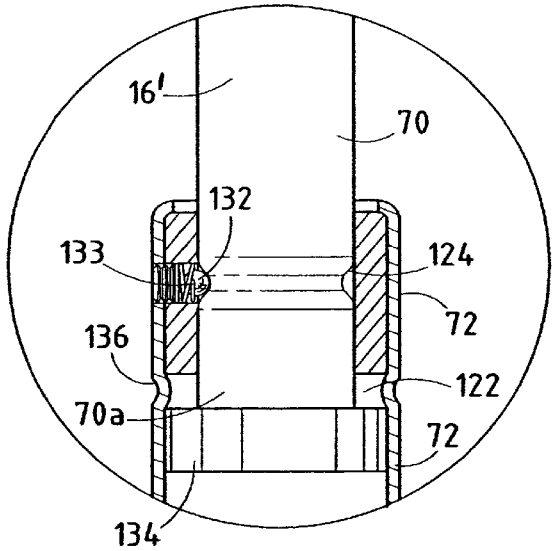
FIG. 11 is an enlarged partial cross-sectional view of area XI in FIG. 9.
Figure 12:
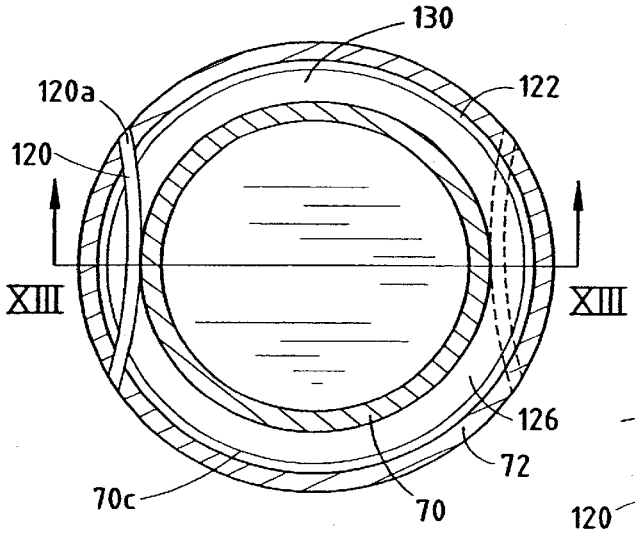
FIG. 12 is a cross-sectional view taken substantially along line XII—XII in FIG. 10.
Figure 13:
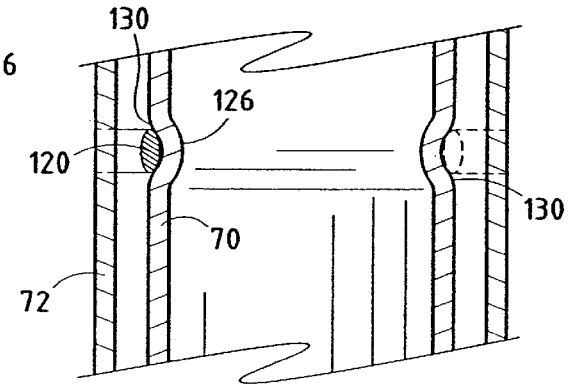
FIG. 13 is a cross-sectional view taken substantially along line XIII—XIII in FIG. 12.

In an alternate embodiment, as shown in FIGS. 9 and 10, a golf bag umbrella 10' may include a shaft 16' with a locking mechanism 78' which may include one or two curved spring bars or retainers 120 attaching at their ends 120*a* to lower tube 72 near an upper end 72*b* of that tube and extending substantially across a hollow opening 122 within lower tube 72 (FIGS. 12 and 13). Spring retainers 120 slide along an outside surface 70*c* of upper tube 70 as upper tube 70 is extended and retracted within lower tube 72, and flex inward at each of a plurality of detents or indentations 124, 126 and 128 positioned along upper tube 70 and corresponding to the extended position shown in FIG. 9, lowered position shown in FIG. 10 and closed position similar to umbrella 10 in FIG. 5, respectively, of shaft 16'. Indentations 124, 126 and 128 may be small crimps on upper tube 70 or may be a circumferential indentation or narrowing of upper tube 70 at each predetermined position, as best shown in FIG. 11. Furthermore, indentations 124, 126 and 128 are preferably rounded at their upper and lower edges 130, to allow for easy movement of upper tube 70 from one position to the next. Although the spring retainer mechanism is preferred, clearly other locking mechanisms may be implemented without effecting the scope of the present invention. For example, as shown in FIG. 11, a ball 132 and spring 133 retainer may be used which similarly engages indentations 124, 126 or 128 to hold the shaft in each of its three positions.

In order to prevent upper tube 70 from being fully removed from lower tube 72, as shaft 16 is fully extended to its extended position, a means for providing a positive stop may be included within shaft 16. In this embodiment, as best shown in FIG. 11, this stop is in a form of a rigid flange 134 extending radially outward at a lower end 70*a* of upper tube 70. Lower tube 72 include s a radially inward extending circumferential indentation or detent 136 located toward upper end 72*b* of lower tube 72 at a position immediately beneath locking mechanism 78'. Detent 136 on lower tube 72 protrudes inwardly into hollow opening 122 of lower tube 72, forming an inner opening that is smaller than the diameter of flange 134 on upper tube 70. Therefore, as shaft 16' is fully extended beyond its extended position shown in FIG. 9, such that indentation 124 is pulled above locking mechanism 78', flange 134 on upper tube 70 engages detent 136 on lower tube 72 to prevent upper tube 70 from being further removed from lower tube 72. Clearly other stop means may instead be implemented to prevent dis assembly of shaft 16 without affecting the scope of the present invention.

In order to secure golf bag umbrella 10' in this lowered position, locking mechanism 78' on lower tube 72 engages indentation 126 on upper tube 70 at a predetermined height such that the lowered position provides minimal clearance between rain cover 23 and a typical long golf club such as a driver or the like. Golf bag umbrella 10' is then easily extended by pulling upward on handle 22 so that upper tube 70 slides upward and outward from lower tube 72 until locking mechanism 78' engages indentation 124 on upper tube 70. Furthermore, when fully retracted to its stored position, locking mechanism 78' may engage an additional indentation 128 on upper tube 70, such that golf bag umbrella 10' is approximately the size of a typical short iron, such as a pitching wedge or a 9 iron, within golf bag 14.

Therefore, each embodiment of the present invention provides optimal protection of golf clubs and other items within a golf bag when the golf bag umbrella is in its lowered and expanded position, as shown in FIG. 1, with canopy 18 covering the golf bag and extending outward beyond the open cavity of the golf bag. Protective cover 20 provides a means to both protect support structure 24 and the golf clubs from being damaged through contact with one another, while also preventing the golf clubs from being entangled within support structure 24 while the golf bag and its contents are transported along the golf course. Accordingly, sudden movements encountered while the golf bag is transported do not result in the golf clubs becoming entangled within support structure 24, as in cases where a typical umbrella is positioned over a golf bag. Not only does protective cover 20 prevent damage to both the golf clubs and support structure 24, but it further avoids additional frustration on the part of the golfer as the golfer attempts to remove a selected club from within the golf bag for the next shot. As the golf clubs are prevented from becoming entangled within support structure 24, the clubs will be easily removable from the golf bag once the golf bag umbrella is extended to its raised position shown in FIG. 2. Once the club has been removed, the golf bag umbrella may be easily returned to its lowered position to continue to provide protection for the clubs remaining in the golf bag while the golfer takes the next shot. Furthermore, the golf bag umbrella further improves upon a typical golf bag umbrella design in that canopy 18 of the golf bag umbrella may be tightly and compactly folded and wrapped about shaft 16, which may also be retracted into a shorter, closed position, such that the golf bag umbrella only takes up approximately the same amount of space as a typical short golf club. The end result is a golf bag umbrella which is easy to move between its extended and lowered positions, and that provides optimal protection to the golf clubs within a golf bag from both adverse weather conditions and from the internal components of the umbrella canopy itself.

Changes and modifications in these specifically described embodiments can be carried out without departing from the principles of the invention, which is intended to be limited only by the scope of the appended claims, as interpreted according to the principles of patent law.

The embodiments of the invention in which an exclusive property right or privilege is claimed are defined as follows:

1. An umbrella for use in a golf bag for protecting items stored within the golf bag, said umbrella comprising:

a shaft having a lower end and an upper end, wherein said shaft is extendable to an extended position and retractable to at least one lowered positions;

a canopy, said canopy attached to said upper end of said shaft and including an exterior surface, an underside and a support structure which supports said canopy and secures said canopy to said shaft said canopy including a flexible cover; and a protective cover extending over at least a portion of said support structure and being secured to at least one of said underside of said canopy and said support structure, whereby items such as golf clubs within the golf bag are prevented from becoming entangled in and/or damaged by said support structure and said support structure is protected from being damaged by the items in the golf bag, said protective cover being flexible, wherein said canopy is expandable to an open position and collapsible to a closed position, such that when said canopy is collapsed to said closed position, said umbrella is compact for easy storage of said umbrella within a golf bag.

2. The umbrella of claim 1 further including a locking mechanism on said shaft, said locking mechanism securing said shaft in at least one of said extended position and said at least one lowered position.

3. The umbrella of claim 2, wherein said shaft includes an inner shaft and an outer shaft, such that said inner shaft and outer shaft cooperate telescopically to extend and retract said shaft, said locking mechanism including an extending member which expands to extend said shaft to said extended position when an end of said inner shaft aligns with at least one channel along said outer shaft and compresses as said shaft is retracted to said at least one lowered position, said shaft being retained in said at least one lowered position by said end of said inner shaft aligning with a lower stop within said outer shaft.

4. The umbrella of claim 3, wherein said shaft includes a base handle, said outer shaft being slideably inserted within said base handle and secured at a lowered, stored position and a partially extended position.

5. The umbrella of claim 2, wherein said shaft includes an inner shaft and an outer shaft, such that said inner shaft and outer shaft cooperate telescopically to extend and retract said shaft, said locking mechanism being a spring bar positioned on one of said inner and outer shafts, said spring bar cooperating with at least one detent on the other of said inner and outer shafts, said at least one detent corresponding to at least one of said extended position and said at least one lowered position.

6. The umbrella of claim 2, wherein said shaft includes an inner shaft and an outer shaft, such that said inner shaft and outer shaft cooperate telescopically to extend and retract said shaft, said locking mechanism being a ball and spring positioned on one of said inner and outer shafts, said ball cooperating with at least one detent on the other of said inner and outer shafts, said at least one detent corresponding to at least one of said extended position and said at least one lowered position.

7. An umbrella for use in a golf bag for protecting items stored within the golf bag, said umbrella comprising:

a shaft having a lower end and an upper end, wherein said shaft is extendable to an extended position and retractable to at least one lowered position;

a canopy, said canopy attached to said upper end of said shaft and including an exterior surface, an underside and a support structure which supports said canopy and secures said canopy to said shaft; and a protective cover extending over at least a portion of said support structure and being secured to at least one of said underside of said canopy and said support structure, whereby items such as golf clubs within the golf bag are prevented from becoming entangled in and/or damaged by said support structure and said support structure is protected from being damaged by the items in the golf bag.

8. The umbrella of claim 7, wherein said protective cover is a flexible material.

9. The umbrella of claim 8, wherein said protective cover is a mesh netting.

10. The umbrella of claim 7, wherein said protective cover has an inner circumferential edge and an outer circumferential edge and secures to said shaft at said inner circumferential edge and extends radially outward therefrom, said outer circumferential edge being secured at a plurality of locations along said underside of said canopy.

11. The umbrella of claim 10, wherein said support structure of said canopy includes a plurality of arms extending radially outward from said shaft, a free portion of said arms being unattached to said canopy and an attached portion of said arms being attached to said canopy, said attached portion being radially outward of said free portion, wherein said protective cover and said canopy function to substantially encase said free portion of said arms therebetween.

12. The umbrella of claim 7, wherein said canopy is expandable to an open position and collapsible to a closed position, said canopy including a flexible cover, said protective cover being flexible, such that when said canopy is collapsed to said closed position, said umbrella is compact for easy storage of said umbrella within a golf bag, said umbrella further including a closure band for securing said flexible cover in said compact closed position.

13. The umbrella of claim 12, wherein said closure band is a strap which wraps around said canopy and secures said canopy in said closed position.

14. The umbrella of claim 12, wherein said closure band is a sleeve for containing said canopy in a compact form when said canopy is in said closed position.

15. The umbrella of claim 7, wherein said support structure of said canopy includes a plurality of arms extending radially outward from said shaft, a free portion of said arms being unattached to said canopy and an attached portion of said arms being attached to said canopy, said attached portion being radially outward of said free portion, wherein said protective cover and said canopy function to substantially encase said free portion of said arms therebetween.

16. The umbrella of claim 7 further including a locking mechanism on said shaft, said locking mechanism securing said shaft in at least one of said extended position and said at least one lowered position.

17. The umbrella of claim 7 further including a handle positioned above said canopy for easy raising and lowering of said canopy between said at least one lowered position and said extended position.

18. An umbrella for use in a golf bag to provide protection for items such as golf clubs located in the golf bag, said umbrella comprising:

a shaft having a lower end and an upper end, said shaft being extendable to an extended position and retractable to at least one lowered position;

a locking mechanism for locking said shaft in said extended position and in said at least one lowered position;

a canopy having an exterior surface and an underside, said canopy attached to said upper end of said shaft and including a support structure and a flexible cover, said support structure securing said cover to said shaft and supporting said flexible cover for movement between an expanded position in which said cover has a first expanded cover area, and a collapsed position in which said cover has a reduced, stored area; and a protective cover extending over at least a portion of said support structure and being secured to at least one of said underside of said canopy and said support structure, whereby items such as golf clubs within the golf bag are prevented from becoming entangled in and/or damaged by said support structure and said support structure is protected from being damaged by the items in the golf bag.

19. The umbrella of claim 18, wherein said shaft includes an inner shaft and an outer shaft, such that said inner shaft and outer shaft cooperate telescopically to extend and retract said shaft between said extended position and said at least one lowered position.

20. The umbrella of claim 19, wherein said shaft includes a stop which prevents said inner shaft from being fully withdrawn from said outer shaft.

21. The umbrella of claim 19, wherein said outer shaft is a lower elongated tube having a first diameter and said inner shaft is an upper elongated tube having a second diameter, said first diameter being larger than said second diameter such that said upper tube slideably inserts within said lower tube with a lower end of said upper tube extending downward into said lower tube, said canopy attaching to an upper end of said upper tube, said upper tube sliding within said lower tube such that said shaft is adjustable between said extended position and said at least one lowered position.

22. The umbrella of claim 21, wherein said locking mechanism is a spring retainer positioned on said lower tube, said upper tube including a plurality of detents corresponding to said extended position and said at least one lowered position, said spring retainer comprising a curved spring element connected at both ends to said lower tube such that said spring element engages said detents on said upper tube as said upper tube is moved into said extended position and said at least one lowered position.

23. The umbrella of claim 22, wherein said detent on said lower tube is circumferential.

24. The umbrella of claim 22, wherein said locking mechanism includes two curved spring elements positioned on opposite sides of said first tube.

25. The umbrella of claim 21, wherein said locking mechanism is a spring and ball detent, said upper tube including a detent, said ball being urged into engagement with said detent at a predetermined position on said upper tube as said upper tube is moved into said extended position and said at least one lowered position.

26. The umbrella of claim 21, wherein said shaft includes a stop which prevents said upper tube from being fully withdrawn from said lower tube.

27. The umbrella of claim 26, wherein said stop is a flange extending radially outward from said lower end of said upper tube, said flange cooperating with a corresponding lip extending radially inward at an upper end of said lower tube.

28. The umbrella of claim 21, wherein said locking mechanism includes a spring and at least one end piece rotatably mounted to a lower end of said upper tube, said lower tube including an upper stop and a lower stop along an interior surface of said lower tube, said spring exerting an upward force on said upper tube to move said upper tube outward from said lower tube and said at least one end piece aligned with said upper stop and engaging said upper stop to prevent outward movement beyond said extended position, said spring being compressible such that said at least one end piece aligns with said lower stop and engages said lower stop to secure said shaft in said lowered position.

29. The umbrella of claim 28, wherein said shaft further includes a base handle which is slidably secured to said lower tube, said lower tube being extendable upward from said base handle to be substantially secured in a partially extended position and said lower tube being insertable into said base handle to be secured in a storage position.

30. The umbrella of claim 18 further including a handle positioned above said canopy for easy raising and lowering of said canopy between said at least one lowered position and said extended position.

31. The umbrella of claim 30, wherein said handle is in the shape of a golf ball.

32. The umbrella of claim 30, wherein said handle is substantially ring-shaped.

33. The umbrella of claim 30, wherein said handle is in the shape of a golf club grip.

34. The umbrella of claim 18 further including a base handle at said lower end of said shaft.

35. The umbrella of claim 34, wherein said base handle is adapted to be fixedly mounted to a lower surface of the golf bag.

36. An umbrella for use in a golf bag to provide protection for items such as golf clubs located in the golf bag, said umbrella comprising:

a shaft comprising a plurality of sections, said shaft having a lower end and an upper end, said shaft being extendable to an extended position and retractable to at least one lowered position;

a locking mechanism for locking said shaft in said extended position and in said at least one lowered position, said shaft being movable between said extended position and said at least one lowered position by a force exerted on said umbrella at a location remote from said locking mechanism;

a canopy having an exterior surface and an underside, said canopy attached to said upper end of said shaft and including a support structure and a flexible cover, said support structure securing said cover to said shaft and supporting said flexible cover for movement between an expanded position in which said cover has a first expanded cover area, and a collapsed position in which said cover has a reduced, stored area; and a protective cover extending over at least a portion of said support structure and being secured to at least one of said underside of said canopy and said support structure whereby items such as golf clubs within the golf bag are prevented from becoming entangled in and/or damaged by said support structure and said support structure is protected from being damaged by the items in the golf bag by said protective cover.

37. The umbrella of claim 36, wherein said shaft includes an inner tube and an outer tube, said inner tube slidably inserted within said outer tube, said outer tube encasing a spring for exerting an upward force against said inner tube to extend said inner tube outward from said outer tube, said inner tube including a stop member which is rotatably alignable with a lower stop within said outer tube and an upper stop within said outer tube, said stop member engaging said lower stop in said lowered position and said upper stop in said extended position, said shaft being movable between said lowered and extended positions by a downward force being occasionally exerted on an upper end of said umbrella.

38. The umbrella of claim 37, wherein said stop member includes a plurality of arms, said arms engaging a plurality of teeth on a lower end of said inner tube, said stop member operatively cooperating with said teeth and said outer tube to align with and engage at least one of said upper stop and said lower stop when the remote force is exerted on said umbrella, said spring exerting a force on said stop member to retain said stop member at said at least one of said upper stop and said lower stop.

39. The umbrella of claim 36, wherein said shaft further includes a base handle, said base handle slidably engaging said lower end of said shaft, said base handle and said lower end being securable at a partially extended position and a lowered stored position.

40. The umbrella of claim 39, wherein said base handle includes at least one upper hole and at least one lower hole, said lower end of said shaft including a retaining element which engages at least one of said at least one upper hole and said at least one lower hole to prevent relative movement between said lower end of said shaft and said base handle, said at least one upper hole corresponding to said partially extended position and said at least one lower hole corresponding to said lowered stored position.

41. A method for protecting golf equipment within a golf bag from adverse weather conditions comprising:

providing a golf bag which contains golf equipment partially extending from an upper end of said golf bag;

providing a golf bag umbrella having a shaft, a canopy and a protective cover, said canopy being attached to said shaft and having an underside and a support structure which supports said canopy and secures said canopy to said shaft, said protective cover extending over at least a portion of said support structure and being secured to at least one of said underside of said canopy and said support structure;

placing said shaft of said umbrella at said golf bag; and positioning said umbrella such that said canopy extends over said golf bag and engaging said golf equipment with said protective cover such that said golf equipment within said golf bag is prevented from becoming entangled in and/or damaged by said support structure and said support structure is protected from being damaged by said golf equipment in said golf bag.

42. The method of claim 41 including placing a lower end of said shaft within and at a lower end of said golf bag, such that an upper end of said shaft extends above said golf bag.

43. The method of claim 41, wherein said canopy is expandable to an open position and collapsible to a closed position, said method including opening said canopy such that said canopy is expanded to the open position.

44. The method of claim 43 including extending said shaft to an extended position prior to opening said canopy.

45. The method of claim 44, wherein said umbrella includes a locking mechanism on said shaft, said method including locking said shaft in the extended position.

46. The method of claim 41 including securing said shaft in at least one of an extended position and a lowered position with a locking mechanism on said shaft.

47. A method for protecting golf equipment within a golf bag from adverse weather conditions comprising:

providing a golf bag which is adapted to contain golf equipment partially extending from an upper end of said golf bag;

providing a golf bag umbrella having a shaft, a canopy and a protective cover, said canopy being attached to said shaft and having an underside and a support structure which supports said canopy and secures said canopy to said shaft, said protective cover extending over at least a portion of said support structure and being secured to at least one of said underside of said canopy and said support structure; and placing said golf bag umbrella at said golf bag such that said canopy is positionable over said golf bag.

48. The method of claim 47 including placing a lower end of said shaft within and at a lower end of said golf bag, such that an upper end of said shaft extends above said golf bag.

49. The method of claim 47 including opening said canopy such that said canopy is expanded to an open position.

50. The method of claim 49 including extending said shaft to an extended position prior to opening said canopy.

51. The method of claim 50 including locking said shaft in the extended position.

52. The method of claim 49 including securing said shaft in at least one of an extended position and a lowered position with a locking mechanism on said shaft.

* * * * *

UNITED STATES PATENT AND TRADEMARK OFFICE

CERTIFICATE OF CORRECTION

PATENT NO. : 6,263,891 B1
DATED : July 24, 2001
INVENTOR(S) : Mark S. Hartwell and Michael J. Hartwell It is certified that error appears in the above-identified patent and that said Letters Patent is hereby corrected as shown below:

Column 10,
Line 18, "positions" should be -- position --
Line 22, insert -- , -- after "said shaft"

Column 13,
Line 64, insert -- , -- after "structure"

Column 16,
Line 15, "claim 49" should be -- claim 47 --

Signed and Sealed this

Twenty-fourth Day of June, 2003

JAMES E. ROGAN
*Director of the United States Patent and Trademark Office*